United States Patent [19]

Nakanishi et al.

[11] Patent Number: 4,790,745

[45] Date of Patent: Dec. 13, 1988

[54] AUTOMATIC FIRE-EXTINGUISHING DEVICE FOR OIL BURNER

[75] Inventors: Yutaka Nakanishi; Toshihiko Yamada; Junji Mizuno, all of Aichi, Japan

[73] Assignee: Toyotomi Kogyo Co., Ltd., Aichi, Japan

[21] Appl. No.: 31,645

[22] Filed: Mar. 30, 1987

[30] Foreign Application Priority Data

Mar. 29, 1986 [JP] Japan ..... 61-46918[U]
Mar. 29, 1986 [JP] Japan ..... 61-46919[U]
Mar. 29, 1986 [JP] Japan ..... 61-46920[U]

[51] Int. Cl.[4] ..... F23N 5/24

[52] U.S. Cl. ..... 431/88; 431/301; 431/307; 431/33; 126/96

[58] Field of Search ..... 431/88, 144, 304, 307, 431/317, 33; 126/96

[56] References Cited

U.S. PATENT DOCUMENTS 4,363,620 12/1982 Nakamura et al. ..... 431/33
4,417,870 11/1983 Nakamura et al. ..... 431/307
4,498,862 2/1985 Nakamura et al. ..... 431/317
4,548,575 10/1985 Hirauchi ..... 431/317
4,608,010 8/1986 Nakamura et al. ..... 431/88
4,613,298 9/1986 Harada et al. ..... 431/88

FOREIGN PATENT DOCUMENTS 156960 1/1978 Japan .
114182 4/1978 Japan .
180951 6/1979 Japan .
77541 7/1979 Japan .
0212611 12/1984 Japan ..... 431/304
0243411 12/1985 Japan ..... 431/88
0003905 1/1986 Japan ..... 431/304

*Primary Examiner*—Margaret A. Focarino
*Attorney, Agent, or Firm*—Pollock, Vande Sande & Priddy

[57] ABSTRACT

An automatic fire-extinguishing device for an oil burner capable of being manufactured with a low cost, compacted in construction and actuated with high accuracy. In the device, a gear which is loosely fitted on a wick actuating shaft and has a return spring loosely fitted on the shaft and fixed between the gear and a burner body is formed with a cutout about a portion thereof opposite to a stopper engaged with the gear when the gear is at a wick raising position. At the cutout is arranged a stop gear so as to be engaged with the stopper at the wick raising position, which is formed of a material having a friction coefficient smaller than that of the gear.

13 Claims, 7 Drawing Sheets

AUTOMATIC FIRE-EXTINGUISHING DEVICE FOR OIL BURNER

BACKGROUND OF THE INVENTION

1. Field of the Invention

This invention relates to an automatic fire-extinguishing device for an oil burner, and more particularly to an automatic fire-extinguishing device for a wick-ignition type oil burner adapted to vertically move a wick for ignition and fire-extinguishing.

2. Description of the Prior Art

In a wick-ignition type oil burner, fire-extinguishing is generally carried out by lowering a wick in a wick receiving construction. For the purpose of automatic fire-extinguishing of an oil burner, an automatic fire-extinguishing device was proposed which is constructed to rotate a gear which has a return spring loosely fitted on a wick operating shaft to wind up the return spring and then engage the gear with a stopper to hold the return spring at a wound-up state during the operation of raising the wick to a wick raising position or ignition position. In an emergency such as earthquake or the like, the wound-up return spring is released from the stopper to forcibly lower the wick to a wick lowering position or fire-extinguishing position to attain fire-extinguishing.

Also, in relation to such a fire-extinguishing device, a device for adjusting a vertical position of a wick was proposed as disclosed in Japanese Utility Model Application No. 77541/1979 filed by the assignee, which is so constructed that a holding plate rotated with a gear selects a desired one of teeth of the gear which is to be engaged with a stopper at a wick raising position, to thereby adjust a vertical position of the wick.

In the conventional fire-extinguishing device, the gear which is engaged with the stopper to hold the return spring at a wound-up state is constantly applied thereto force of the return spring, accordingly, great operating force is required to release the stopper from engagement with the gear in an emergency. Also, this causes a variation in the operating force to be increased. In order to accommodate such problems, it was proposed to make the gear of a material having a low friction coefficient such as plastic or the like or subject it to a surface treatment to decrease friction between the gear and the stopper. Unfortunately, such a plastic material is inferior in impact strength, and materials of a low friction other than plastic are generally expensive. Also, the surface treatment is costly.

In the conventional automatic fire-extinguishing device, disengagement of the stopper from the gear in an emergency is carried out by tilting or bringing down a vibration sensing weight to actuate the stopper. The vibration sensing weight is divided into two types or a self-standing type and an outside-help type. In the former type, the weight is constructed to have a small tilting angle, accordingly, it is required to manufacture parts constituting the weight with high accuracy; whereas the latter type is adapted to be manually reset through a suitable means such as a set lever or the like, resulting in being highly troublesome.

In view of such disadvantages, a weight reset device was proposed which is disclosed in Japanese Utility Model No. 156960/1978 filed by the assignee. In the device, a spring is arranged to force a stopper against a gear and the gear is formed with a tooth-less portion at a position thereof which is rendered opposite to the stopper when a wick is lowered to a fire-extinguishing position, so that the spring forces the stopper against the tooth-less portion of the gear to reset or raise up the weight through a stopper actuating plate of the weight operatively connected to the stopper. However, this is still insufficient to positively and effectively automatically reset the weight.

Also, Japanese utility Model Application Nos. 114182/1978 and 180951/1979 each disclose a structure that a wick operating shaft actuates a set lever for resetting or raising up a tilted vibration sensing weight at a fire-extinguishing position. Unfortunately, such a structure causes a fire-extinguishing device to be highly complicated in construction, resulting in an oil burner being large-sized and expensive.

Accordingly, it would be highly desirable to develop an automatic fire-extinguishing device for an oil burner which is capable of being actuated with high accuracy, being manufactured with a low cost, positively setting up a vibration sensing weight in a simple manner.

SUMMARY OF THE INVENTION

Briefly speaking, in accordance with the present invention, an automatic fire-extinguishing device for an oil burner including a burner body is provided. The device includes a wick operating shaft mounted on the burner body, which is rotated to vertically move a wick. On the wick operating shaft are loosely fitted a gear and a return spring. The return spring is fixedly interposed between the gear and the burner body of the oil burner. Also, the device includes a stopper mounted on the burner body and forced toward the gear so as to be engaged with the gear. Operative engagement between the wick operating shaft and gear is carried out by an engagement means which is adapted to rotate the gear with the wick operating shaft to wind the return spring during wick raising operation. The stopper is releasably engaged with the gear to stop rotation of the gear to keep the return spring at a wound-up state. The gear is formed with a first cutout about a portion thereof opposite to the stopper when it is at a wick raising position, at which a stop gear is arranged so as to be engaged with the stopper at the wick raising position. The stop gear is made of a material having a friction coefficient lower than that of the gear.

Accordingly, it is an object of the present invention to provide an automatic fire-extinguishing device for an oil burner which is capable of being manufactured with a low cost.

It is another object of the present invention to provide an automatic fire-extinguishing device for an oil burner which is capable of being compacted in construction.

It is a further object of the present invention to provide an automatic fire-extinguishing device for an oil burner which is capable of being actuated with high accuracy in an emergency.

It is still another object of the present invention to provide an automatic fire-extinguishing device for an oil burner which is capable of effectively automatically raising up a vibration sensing weight tilted.

It is yet another object of the present invention to provide an automatic fire-extinguishing device for an oil burner which is capable of being actuated with good operability.

It is still a further object of the present invention to provide an automatic fire-extinguishing device for an oil burner which is capable of eliminating any trouble due to a vibration sensing weight.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings in which like reference numerals designate like or corresponding parts throughout; wherein:

FIGS. 5 to 7 each are a schematic front elevation view showing another embodiment of an automatic fire-extinguishing device according to the present invention, wherein FIG. 5 shows a wick lowering position of the device, FIG. 6 shows a wick raising position of the device and FIG. 7 shows a state that a vibration sensing weight has been actuated or tilted;

FIGS. 9 to 11 each are a schematic side elevation showing actuation of the device shown in FIG. 8, wherein FIG. 9 shows a wick lowering position of the device, FIG. 10 is a wick raising position of the device and FIG. 11 shows actuation of a vibration sensing weight; and FIGS. 12 to 14 each are a schematic side elevation view showing a modification of the automatic fire-extinguishing device of FIG. 8, wherein FIG. 12 shows a wick lowering position of the modification, FIG. 13 shows a way to a wick raising position of the modification and FIG. 14 shows its wick raising position.

DETAILED DESCRIPTION OF THE PREFERRED EMBODIMENTS

Now, an automatic fire-extinguishing device for an oil burner according to the present invention will be described hereinafter with reference to the accompanying drawings.

Figure 1:
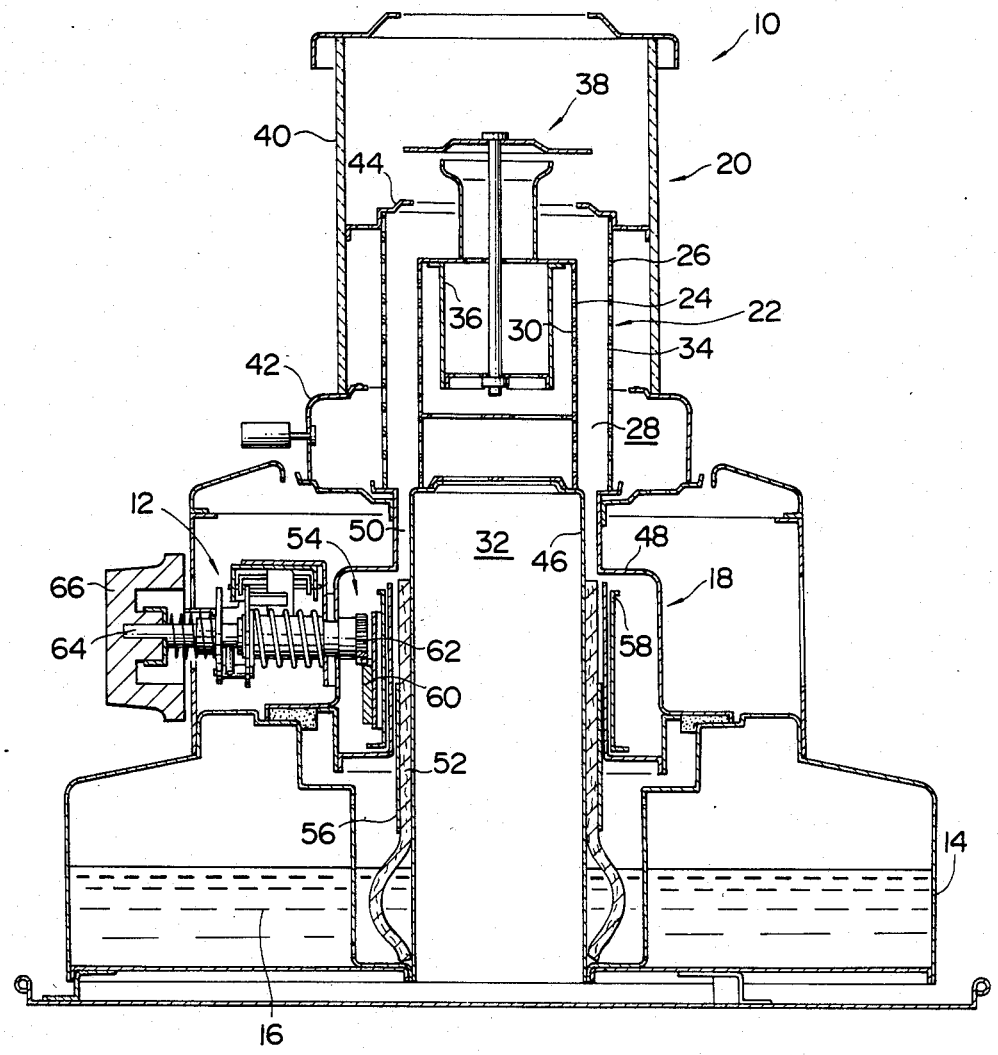
FIG. 1 is a vertical sectional view generally showing an example of a wick-ignition type oil burner which is adapted to incorporate an automatic fire-extinguishing device of the present invention therein.

Referring now to FIG. 1, there is schematically illustrated a wick-ignition oil burner which is generally designated by reference numeral 10 and adapted to incorporate therein an automatic fire-extinguishing device according to the present invention. In FIG. 1, an automatic fire-extinguishing device of the present invention is generally designated by reference numeral 12. The oil burner 10 is a red-heated type oil-fired space heater, however, it should be noted that an oil burner in which the present invention is to be incorporated is not limited to such an oil-fired space heater.

The oil burner 10 itself may be constructed in such a manner as widely known in the art. The oil burner 10 generally comprises an oil reservoir 14 for storing therein fuel oil 16 such as kerosene, a wick receiving construction 18 arranged on the oil reservoir 14 and a combustion cylinder construction 20 arranged on the wick receiving construction 18.

The combustion cylinder construction 20 includes a double-cylinder combustion means 22 comprising an inner cylinder 24 and an outer cylinder 26 arranged to define a space 28 therebetween. The inner cylinder 24 is provided with a plurality of through-holes 30 which act to supply a part of combustion air from a lower portion of an internal space 32 formed in a burner body of the oil burner therethrough to the space 28. The outer cylinder 26 likewise is provided with a plurality of through-holes 34. Reference numeral 36 designates an internal cylinder which is surrounded by the inner cylinder 24 and on which a flame spreading means 38 is mounted. The combustion cylinder construction 20 also includes a heat-permeable cylinder 40 which is supported through a non-permeable cylinder 42 on the wick receiving construction 18. The outer cylinder 26 is provided at an upper end thereof with an annular top plate 44 of which an outer end extends to the heat-permeable cylinder 40 and an inner end extends inwardly from the outer cylinder 26 and terminates substantially above the inner cylinder 24.

The wick receiving construction 18 may be constructed in such a manner as disclosed in U.S. Pat. No. 4,363,620 issued to Nakamura et al on Dec. 14, 1982. The wick receiving construction 18 includes an inner cylinder 46 and an outer cylinder 48 which are concentrically arranged so as to define an annular chamber 50 therebetween sufficient to vertically movably receive a wick 52 therein. The annular chamber 50 is communicated to the space 28 of the combustion cylinder construction 20, so that when combustion is to be carried out, the wick 52 is raised at an upper end thereof to a lower portion of the space. The wick 52 is constantly immersed at a lower portion thereof in the fuel oil 16. In FIG. 1, the wick 52 is lowered to a fire-extinguishing position. Between the inner cylinder 46 and the outer cylinder 48 is arranged a wick actuation means 54 for vertically moving the wick 52 depending on actuation of the automatic fire-extinguishing device 12 of the present invention which will be detailedly described hereinafter. The wick actuation means 54 may be constructed in a manner widely known in the art and includes an annular retaining plate 56 for retaining the wick 52 thereon, an annular actuation plate 58 for rotating the wick retaining plate 56. A rack 60 is mounted on the actuation plate 58 and correspondingly a pinion 62 is fixed on an inner end of a wick operating shaft 64 which constitutes a part of the automatic fire-extinguishing device of the present invention. The connection between the wick retaining plate 56 and the actuation plate 58 may be carried out by means of a suitable conventional means such as a connecting pin (not shown).

Figure 2:
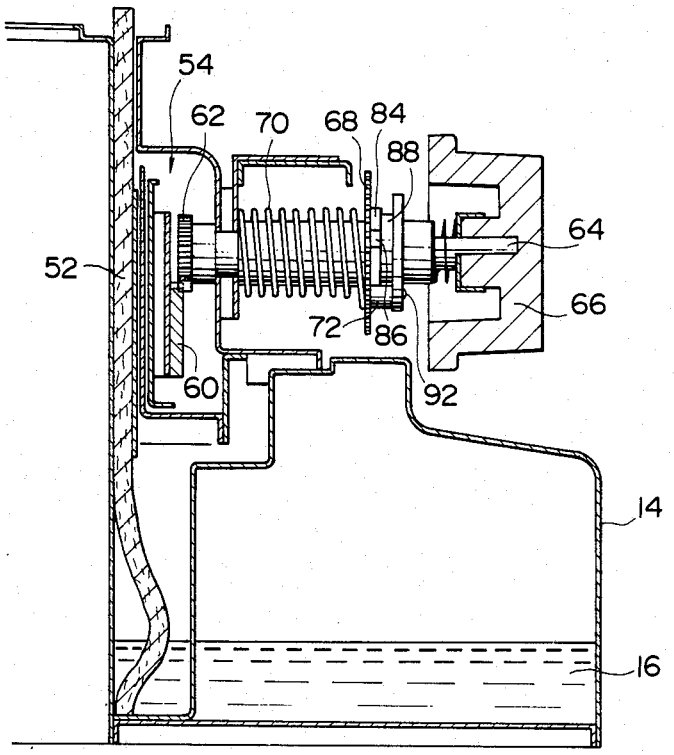
FIG. 2 is a vertical sectional side elevation view showing an embodiment of an automatic fire-extinguishing device for an oil burner according to the present invention.
Figure 3:
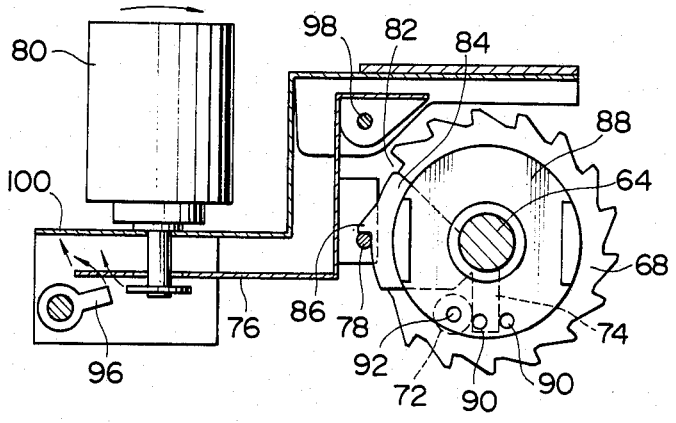
FIG. 3 is a schematic front elevation view in section showing the device of FIG. 2.
Figure 4:
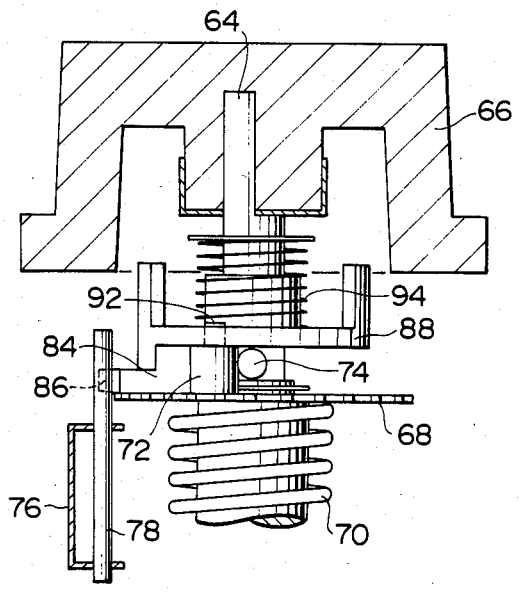
FIG. 4 is a plan view partly in section showing an essential part of the device of FIG. 2.

FIGS. 2 to 4 illustrates an embodiment of a fire-extinguishing device according to the present invention.

A device of the illustrated embodiment includes a wick operating shaft 64 having a knob 66 mounted at an outer end thereof which serves to rotate the shaft through its manual operation. The automatic fire-extinguishing device also includes a gear 68 freely fitted on the wick operating shaft 64 and a return spring 70 freely fitted on the wick operating shaft 64 and fixedly interposed between the burner body of the oil burner and the gear 68. The gear 68 has a rod 72 mounted thereon so as to extend toward the knob 66. The wick operating shaft 64 is provided thereon with a radially outwardly extending pin member 74. When the wick operating shaft 64 is rotated in a wick raising direction through the knob 66, the wick is raised by the wick actuation mechanism 54 through the shaft 64 and the pin member 74 is abutted against the rod 72 of the gear 68 and then push it to rotate the gear and wind the return spring 70. The device of the illustrated embodiment further includes a stopper 76 which is provide at one end thereof with an holding pin 78 and operatively engaged at the other end thereof with a vibration sensing weight 80. The stopper 76 is adapted to be engaged at the holding pin 78 with the gear 68 to hold the return spring at a wound-up state when rotation of the wick operating shaft 64 in a wick raising direction or in a clockwise direction in FIG. 3 is stopped at any position. In FIG. 3, the gear 68 is held at a wick raising position at which the wick is raised to an uppermost position or combustion position. The gear 68 is formed with a cutout or recess 82 about a portion thereof opposite to the holding pin 78 of the stopper 76 at the wick raising position and a stop gear 84 is arranged at the cutout 82 of the gear 68 to substitute for the gear 68. In the illustrated embodiment, the stop gear 84 comprises a segment gear formed with a single tooth 86 and is superposed on the gear 68. The stop gear 84 is formed of a material having a low friction coefficient such as, for example, synthetic resin including polyacetal, metal coated with fluoroplastic, or the like.

In the illustrated embodiment, the stop gear 84 is provided on an inner surface of a circular control member 88 loosely fitted on the wick operating shaft 64 and positioned between the gear 68 and the knob 66 in a manner to be integral with the member 88. The stop gear 84 is formed with a plurality of through-holes 90, in any one of which a pin-like projection 92 provided on the gear 68 so as to extend toward the circular control member 88 is fitted, so that a vertical position of the wick may be variably determined depending on selection of any one of the through-holes 90 of the control member 88 in which the pin-like projection 92 is to be fitted. In the illustrated embodiment, the through-holes 90 are formed in the annular control member 88 on which the stop gear 84 is integrally mounted and the pin-like projection 92 is mounted on a distal end surface of the rod 72.

Between the control member 88 and the knob 66 is interposed a holding spring 94, which is fitted on the wick operating shaft 64 and serves to press the stop gear 84 against the gear 68 to cause the former to be actuated together with the latter.

Reference numeral 96 designates a set lever for manually operating the stopper 76. When the vibration sensing weight 80 falls down due to vibration sufficient to actuate it or the set lever 96 is operated during combustion operation, the stopper 76 is actuated to be pivotally moved about a pivot shaft 98 in a clockwise direction in FIG. 3, so that the stopper 76 may be released from engagement with the tooth 86 of the stop gear 84 to cause the gear 68 to be rotated in a wick lowering direction or fire-extinguishing direction (couterclockwise direction in FIG. 3) due to force of the wound-up return spring, resulting in fire-extinguishing of the oil burner being carried out.

Now, the manner of operation of the automatic fire-extinguishing device of the illustrated embodiment described above will be described hereinafter with reference to FIGS. 1 to 4.

When the wick operating shaft 64 is rotated in the wick raising direction, the wick 52 is raised to the uppermost position by the wick actuation mechanism 54 and the pin member 74 of the wick operating shaft 64 is abuttedly engaged with the rod 72 of the gear 68 to rotate the gear to the wick raising position as shown in FIG. 3 and wind up the return spring. The portion of the gear 68 opposite to the stopper 76 at the wick raising position is formed with the cutout 82 and substitutionally provided with the stop gear 84 formed with the tooth 86, accordingly, the stopper 76 is engaged with the tooth 86 of the stop gear 84 to keep the return spring at a wound-up state. Then, when ignition of the wick is carried out, combustion takes place in the combustion cylinder construction 20 to red-heat the inner and outer cylinders 24 and 26. The red-heated cylinders emit heat rays therefrom, which are discharged through the heat-permeable cylinder 40. Also, during the combustion, the flame spreading means 38 forms a long flame of which heat rays likewise are emitted through the heat-permeable cylinder 40. Combustion gas of a high temperature produced due to the combustion is upwardly discharged from an upper open end of the oil burner.

Fire-extinguishing of the oil burner is carried out by disengaging the stopper 76 from the stop gear 84 due to actuation of the vibration sensing weight 80 or the like to lower the wick to the fire-extinguishing position. The stop gear 84, as described above, is formed of a material having a low friction coefficient, accordingly, the disengagement of the stopper 76 from the stop gear 84 is carried out with weak force without any trouble.

As can be seen from the foregoing, in the illustrated embodiment, the stop gear 84 which is kept at a state engaged with the stopper 76 throughout combustion operation of the oil burner is formed of a material of a low friction coefficient, accordingly, the gear 68 itself can be made of a material of a low cost. Also, the stop gear can be highly small-sized as compared with the gear 68. Further, the stop gear 84 can be formed of a material having low impact strength so long as it exhibits a low friction property, because any impact thereto is substantially applied to the gear 68. Thus, the illustrated embodiment significantly decreases the manufacturing cost and renders the construction compact.

Further, in the illustrated embodiment, position of the stop gear 84 with respect to the gear 68 is variably set depending on selection of any one of the through-holes 90 in which the pin-like projection 92 is fitted, so that the tooth 86 of the stop gear 84 may be variably positioned with respect to the cutout 82 of the gear 68. Such construction permits a combustion position of the wick to be varied as desired.

Figure 5:
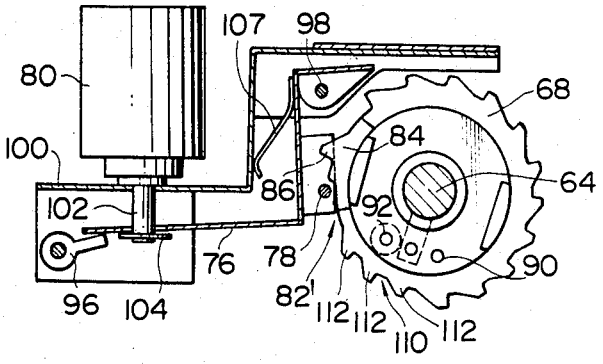

FIG. 5 shows another embodiment of an automatic fire-extinguishing device according to the present invention. The embodiment of FIG. 5 is constructed to positively reset or raise up a vibration sensing weight as well as exhibit the advantage of the above-described. More particularly, the embodiment includes a vibration sensing weight 80 pivotally supported on a horizontal base plate 100 of the burner body of the oil burner 10 described above and having a shaft 102 mounted on a lower portion of the weight 80 so as to downwardly extend therefrom. On a lower end of the actuation shaft 102 is mounted a stopper actuator 104 which is adapted to actuate a stopper 76 when the vibration sensing weight 80 falls down. The stopper actuator 104, in the embodiment, comprises a circular plate and, at a normal state, is arranged opposite to the stopper 76 through a gap 106 (FIG. 6) defined therebetween. The stopper 76 is adapted to be pivotally moved about a pivot shaft 98. The fire-extinguishing device of the illustrated embodiment also includes an elastic means or bias spring 107 for forcing stopper 76 in the counterclockwise direction in FIG. 5 to securely engage a holding pin 78 of the stopper 76 with a tooth 86 of a stop gear 84. In the illustrated embodiment, the elastic means or bias spring 107 comprises a leaf spring arranged between the burner body of the oil burner and the stopper 76. The gear 68 is provided with a cutout or recess 82' as in the above-described embodiment. However, the cutout 82' is formed to have a length larger than that of the cutout 82 of the embodiment shown in FIGS. 2 to 4. More particularly, the cutout 82' is formed so as to extend from a first portion 108 of the gear 68 opposite to the stopper 76 at a wick raising position of the gear to a second portion 110 of the gear 68 opposite to the stopper 76 at a wick lowering position thereof. In the embodiment, both portions 108 and 110 are formed contiguous to each other in a counterclockwise direction in FIG. 5. At the first portion 108 of the cutout 82' is arranged the stop gear 84 in a manner to be superpose on the gear 68, to thereby substitute for the gear 68. The second portion 110 of the cutout 82' is formed to have a depth larger than that of a root of each of teeth of the gear 68. Also, the second portion 110 is formed with at least one tooth 112. In the embodiment illustrated, three such teeth 112 are arranged in order on the second portion 110. The remaining part of the embodiment may be constructed in substantially the same manner as that shown in FIGS. 2 to 4.

Now, the manner of operation of the embodiment shown in FIG. 5 will be described hereinafter with reference to FIGS. 1 and 5 to 7.

Figure 6:
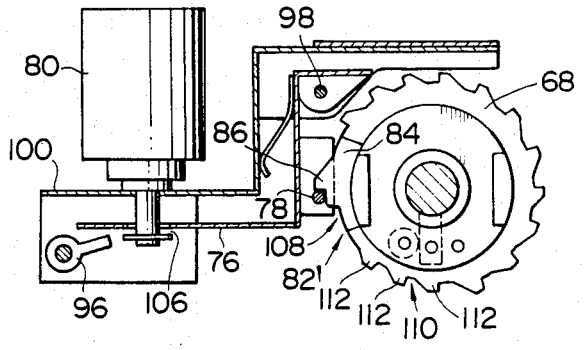

When a wick operating shaft 64 is rotated in a wick raising direction from the wick lowering position of FIG. 5, a wick 52 is raised to an ignition position by the wick actuation mechanism 54 and a pin member 74 of the wick operating shaft 64 is abuttedly engaged with a rod 72 of the gear 68 to rotate the gear to the wick raising position shown in FIG. 6 and wind up a return spring 70. This results in the stopper 76 being engaged with the tooth 86 of the stop gear 84 to keep the return spring 70 at a wound-up state. Then, when ignition of the wick is carried out, combustion takes place in a combustion cylinder construction 20 of an oil burner 10.

Figure 7:
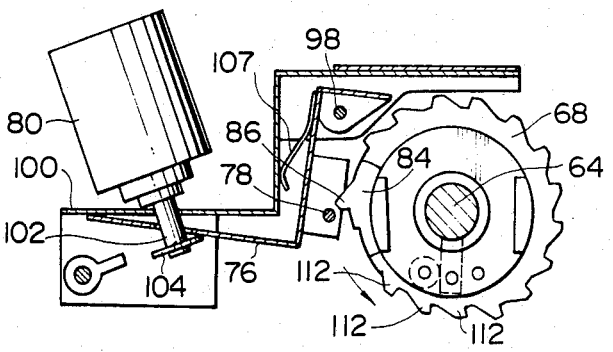

When the vibration sensing weight 80 falls down or tilted due to vibration such as earthquake during combustion operation of the oil burner as shown in FIG. 7, the stopper actuator 104 is pivotally moved through the actuation shaft 102 to push up the stopper 76, so that the stopper 76 is pivotally moved about the pivot shaft 98 in the clockwise direction as shown in FIG. 7, resulting in a holding pin 78 of the stopper 76 being released from engagement with the tooth 86 of the stop gear 84. This causes the gear 68 to be rotated to the wick lowering position shown in FIG. 7 due to action of the wound-up return spring 70, so that the wick 52 may be lowered to the fire-extinguishing position to carry out fire-extinguishing.

The gear 68 is formed with the second portion 110 of cutout 82' having a depth larger than that of the root of each tooth of the gear 68; accordingly, after the weight 80 is actuated as shown in FIG. 7, the spring 107 presses the holding pin 78 of the stopper 76 against the deep second portion 110 to pivotally move the stopper 76 about the pivot shaft 98 in the counterclockwise direction in FIG. 7. This causes a portion of the stopper 76 opposite to the stopper actuator 104 to push down the stopper actuator 104 to pivotally move it in the clockwise direction, resulting in the vibration sensing weight 80 positively being set up for resetting.

As can be seen form the foregoing, the embodiment of FIG. 5 is so constructed that the gear 68 is engaged with the stopper 76 to position it opposite to the stopper actuator 104 of the vibration sensing weight 80 through the gap 106, so that the weight 80 may be precisely actuated in an emergency. Also, the gear 68 is provided with the cutout 82' having the second portion 110 of a depth larger than that of the root of the gear 68 at the portion thereof opposite to the stopper 76 at the wick raising position, so that the stopper 76 may be moved to a degree sufficient to eliminate the gap 106 in the counterclockwise direction by means of the spring 107 as shown in FIG. 7. Thus, the vibration sensing weight 80 can be positively reset as shown in FIG. 7. Further, when the second portion 110 of the cutout 82' is provided with the tooth 112 engaged with the holding pin 78 of the stopper 76 as described above, the return spring 70 can be positively wound up even when the wick operating shaft 64 is rotated beyond one rotation. Also, such construction, even in the case that the stopper 76 is positionally aligned with the second portion 110 of the cutout 82' when rotation of the wick operating shaft 64 in the wick raising direction is interrupted, permits the stop gear 84 to be engaged with the stopper 76 through the tooth 86 to hold the return spring at a wound-up state, resulting in the second portion 110 being prevented from adversely affecting operability of the automatic fire-extinguishing device of the illustrated embodiment.

Figure 8:
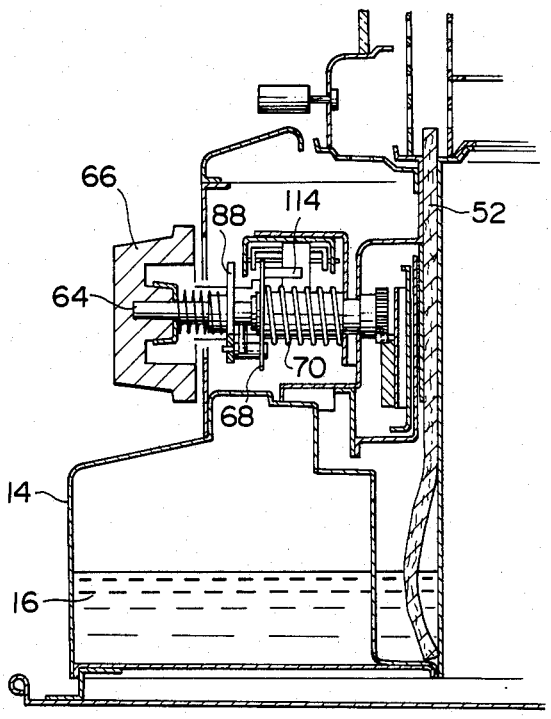
FIG. 8 is a vertical sectional side elevation view showing a further embodiment of an automatic fire-extinguishing device according to the present invention.

FIG. 8 shows a further embodiment of an automatic fire-extinguishing device according to the present invention. The embodiment of FIG. 8 likewise is adapted to effectively carry out the automatic setting up of a vibration sensing weight.

Figure 9:
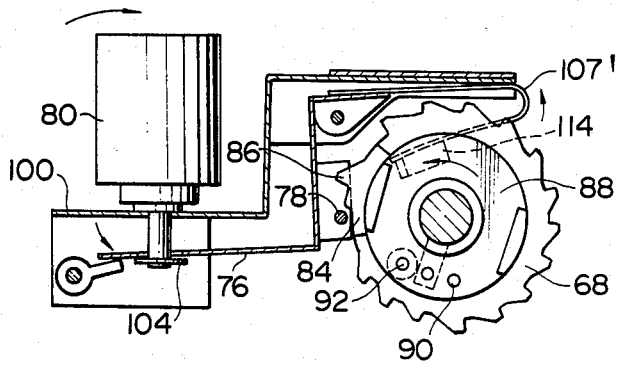
Figure 10:
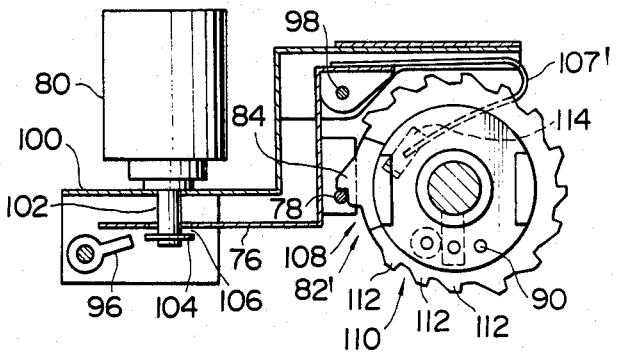
Figure 11:
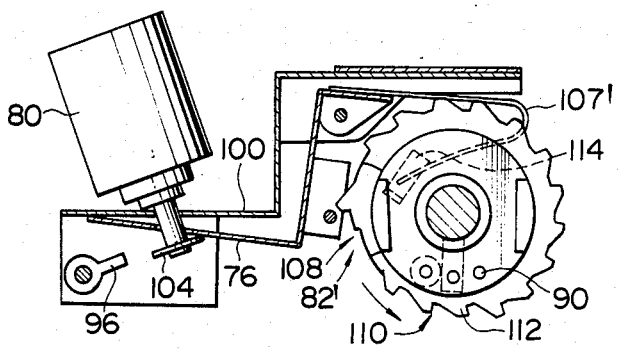

The embodiment of FIG. 8 includes a push-up lever 114 which may be mounted on a wick operating shaft 64 or a gear 68. In the embodiment, the lever 114 is mounted on an inner surface of the gear 68 so as to inwardly extend therefrom. Alternatively, a rod 72 of the gear 68 or a pin member 74 of a wick operating shaft 64 may be used as the push-up lever 114 to more simplify construction of the fire-extinguishing device. Also, the device, as shown in FIGS. 9 to 11, includes an elastic means or actuation spring 107' which is substituted for the elastic means 107 in the embodiment of FIGS. 5 to 7 and, in the embodiment, comprises a leaf spring formed into a substantially V-shape. The actuation spring 107' is mounted at one side thereof on a stopper 76. The other side of the actuation spring 107' is abutted against the push-up lever 114 to pivotally move the stopper 76 about a pivot shaft 98 toward a stopper actuator 104 or in a counterclockwise direction in FIG. 9 when a wick is lowered to a fire-extinguishing position. The elastic means or actuation spring 107' may be arranged between the stopper 76 and the wick operating shaft 64 or a return spring 70 fitted on or wound around the wick operating shaft 70 to constantly force the stopper toward the gear 68. The remaining part of the embodiment may be constructed in substantially the same manner as that of FIGS. 5 to 7.

Now, the manner of operation of the embodiment shown in FIG. 8 will be described hereinafter with reference to FIGS. 1 and 8 to 11.

When the wick operating shaft 64 is rotated in a wick raising direction, a wick 52 is raised to an ignition position by the wick actuation mechanism 54 and the pin member 74 of the wick operating shaft 64 is abuttedly engaged with the rod 72 of the gear 68, to thereby rotate the gear from a wick lowering position shown in FIG. 9 to a wick raising position shown in FIG. 10 and wind up the return spring 70. This results in a holding pin 78 of the stopper 76 being engaged with a tooth 86 of a stop gear 84 to keep the return spring 70 at a wound-up state. Then, when ignition of the wick is carried out, combustion takes place in the combustion cylinder construction 20 of the oil burner 10.

When a vibration sensing weight 80 kept at a state shown in FIG. 10 falls down or tilted due to vibration such as earthquake during combustion operation of the oil burner as shown in FIG. 11, the stopper actuator 104 is pivotally moved through an actuation shaft 102 to push up the stopper 76, so that the stopper 76 is pivotally moved about the pivot shaft 98 in a clockwise direction in FIG. 11, resulting in the holding pin 78 of the stopper 76 being released from engagement with the tooth 86 of the stop gear 84. This causes the gear 68 to be rotated to the wick lowering position shown in FIG. 9 due to action of the wound-up return spring 70, so that the wick 52 may be lowered to the fire-extinguishing position to carry out fire-extinguishing.

The push-up lever 114 is abutted against the the actuation spring 107′ mounted on the stopper 76 at the wick lowering position to pivotally move the stopper in the counterclockwise direction to push the stopper actuator 104 in the clockwise direction to raise up the vibration sensing weight 80 as shown in FIG. 9. Also, at the wick lowering position, the holding pin 78 of the stopper 76 is pressed against a cutout 82′ to eliminate a gap between the stopper actuator 104 and the stopper 76, so that the stopper 76 may more effectively push down the actuator 104.

As can be seen from the foregoing, in the embodiment, pivotal movement of the stopper 76 which causes it to be abutted against the stopper actuator 104 of the weight 80 is carried out by pressing the actuation spring 107′ of the stopper 76 by means of the push-up lever 114, so that excessive movement of the stopper 76 may be absorbed by deformation of the actuation spring, resulting in a space necessary for actuation of the stopper being significantly reduced. Also, the actuation spring 107′ is fully spaced from the push-up lever 114 at the wick raising position, accordingly, force necessary for forcing the stopper 76 against the gear 68 can be substantially obtained by gravity of the stopper. Thus, the vibration sensing weight can be actuated with high accuracy.

Figure 12:
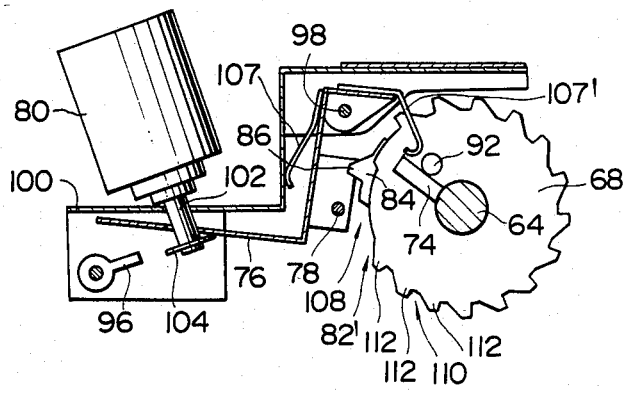
Figure 13:
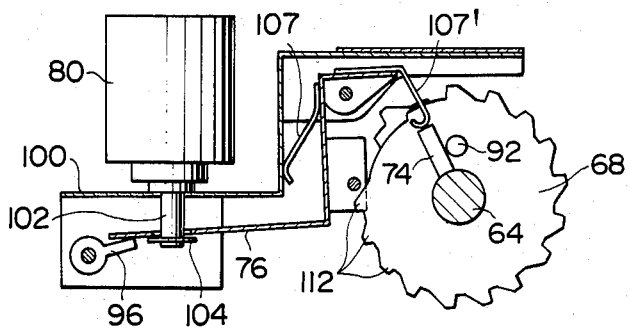
Figure 14:
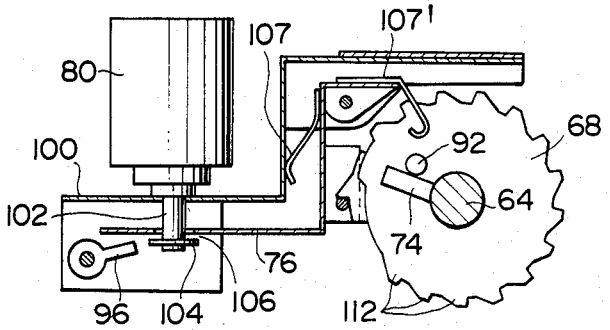

FIGS. 12 to 14 show a modification of the automatic fire-extinguishing device shown in FIG. 8. In the modification, a stop gear 84 is superposed on a rear surface of a gear 68, different from in the embodiment described above. Also, a bias spring 107 is arranged between a burner body and a stopper 76. Further, an actuation spring 107′ is formed into a substantially dog-leg shape to ensure positive engagement between the stopper 76 and the gear 68 at a wick raising position. The remaining of the modification may be constructed in substantially the same manner as the embodiment of FIGS. 12 to 14. Thus, it will be noted that the modification is operated in a manner similar to the embodiment and accomplishes substantially the same advantages.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all the generic and specific features of the invention herein described and all statements of the scope of the invention which, as a matter of language, might be said to fall therebetween.

What is claimed is:

1. An automatic fire-extinguishing device for an oil burner including a burner body, comprising:
   - a wick operating shaft mounted on said burner body and rotated to vertically move a wick;
   - a gear loosely fitted on said wick operating shaft;
   - a return spring loosely fitted on said wick operating shaft and fixedly interposed between said gear with said wick operating shaft to wind said return spring during a wick raising operation;
   - a stopper mounted on said burner body and including a holding portion for releasably engaging said gear to stop rotation of said gear to keep said return spring at a wound-up state, said gear being formed with a first cutout along a peripheral portion thereof which is opposite to the holding portion of said stopper when said gear is at a wick raising position corresponding to a combustion position of said wick;
   - a stop gear operatedly connected to said first gear and arranged at said first cutout so as to be engaged with the holding portion of said stopper as a substitute for said gear at its said wick raising position, said stop gear being made of a material having a friction coefficient smaller than that of said gear.

2. An automatic fire-extinguishing device as defined in claim 1, wherein said stop gear is provided with a single tooth through which it is engaged with the holding portion of said stopper.

3. An automatic fire-extinguishing device as defined in claim 1 further comprising means for variably positioning said stop gear with respect to the first cutout of said gear to variably set the combustion position of said wick relative to said wick raising position of said gear.

4. An automatic fire-extinguishing device for an oil burner as defined in claim 1, wherein said stop gear is arranged on said gear in a manner to be superposed on said gear.

5. An automatic fire-extinguishing device for an oil burner as defined in claim 1, wherein said engagement means comprises a pin member mounted on said wick operating shaft and a rod mounted on said gear so as to be selectively engaged with said pin member.

6. An automatic fire-extinguishing device as defined in claim 1 further comprising:
   - a vibration sensing weight tiltably supported on said burner body, said vibration sensing weight being provided with a stopper actuator for operatively engaging an actuating portion of said stopper actuating portion to define a gap between said stopper actuator and said stopper actuating portion; and, a bias spring for constantly forcing the holding portion of said stopper toward said gear, said gear being formed with a plurality of first teeth and a second cutout along a second peripheral portion thereof which is opposite to the holding portion of said stopper when said gear is at a wick lowering position corresponding to a fire-extinguishing position of said wick, said second cutout having a depth larger than that of each of the first teeth of said gear.

7. An automatic fire extinguishing device as defined in claim 6, wherein said second cutout is contiguous to said first cutout.

8. An automatic fire-extinguishing device as defined in claim 6, wherein said second cutout is formed with at least one tooth other than said first teeth.

9. An automatic fire-extinguishing device as defined in claim 1 further comprising:

a vibration sensing weight tiltably supported on said burner body, said vibration sensing weight being provided with a stopper actuator operatively connected to said stopper;

an actuation spring mounted on said stopper; and, a push-up lever mounted on one of said wick operating shaft and gear, said push-up lever being arranged to be engaged with said actuation spring at a wick lowering position to abut a portion of said stopper against said stopper actuator to raise up said vibration sensing weight when tilted.

10. An automatic fire-extinguishing device as defined in claim 6 further comprising:

an actuation spring mounted on said stopper; and a push-up lever mounted on one of said wick operating shaft and gear, said push-up lever being arranged to be engaged with said actuation spring at the wick lowering position to abut said stopper actuating portion against said stopper actuator to raise up said vibration sensing weight when tilted.

11. An automatic fire-extinguishing device for an oil burner including a burner body, comprising:

a wick operating shaft mounted on said burner body and rotated to vertically move a wick;

a gear loosely fitted on said wick operating shaft and fixedly interposed between said gear and said burner body of said oil burner;

a pin member mounted on said wick operating shaft so as to radially extend therefrom;

a rod mounted on said gear so as to extend in an axial direction of said gear, said rod being engaged with said pin member to rotate said gear with said wick operating shaft to wind said return spring during a wick raising operation;

a stopper mounted on said burner body and including a holding portion for releasably engaging said gear to stop rotation of said gear to keep said return spring at a wound-up state, said gear being formed with a first cutout along a peripheral portion thereof which is opposite to the holding portion of said stopper when said gear is at a wick raising position corresponding to a combustion position of said wick; and, a stop gear operatedly connected to said first gear and arranged at said first cutout so as to be engaged with the holding portion of said stopper as a substitute for said gear at its said wick raising position, said stop gear being formed with a tooth through which said stop gear is engaged with the holding portion of said stopper at the wick raising position to stop rotation of said gear, and said stop gear being made of a material having a friction coefficient lower than that of said gear.

12. An automatic fire-extinguishing device for an oil burner including a burner body, comprising:

a wick operating shaft mounted on said burner body and rotated to vertically move a wick;

a gear loosely fitted on said wick operating shaft;

a return spring loosely fitted on said wick operating shaft and fixedly interposed between said gear and said burner body of said oil burner;

a pin member mounted on said wick operating shaft so as to radially extend therefrom;

a rod mounted on said gear so as to extend in an axial direction of said gear, said rod being engaged with said pin member to rotate said gear with said wick operating shaft to wind said return spring during a wick raising operation;

a stopper mounted on said burner body and including a holding portion for releasably engaging said gear to stop rotation of said gear to keep said return spring at a wound-up state, said gear being formed with a first cutout along a peripheral portion thereof which is opposite to the holding portion of said stopper when said gear is at a wick raising position corresponding to a combustion position of said wick;

a stop gear operatedly connected to said first gear and arranged at said first cutout so as to be engaged with the holding portion of said stopper as a substitute for said gear at its said wick raising position, said stop gear being formed with a tooth through which said stop gear is engaged with the holding portion of said stopper at the wick raising position to stop rotation of said gear, and said stop gear being made of a material having a friction coefficient smaller than that of said gear;

a vibration sensing weight tiltably supported on said burner body, said vibration sensing weight being provided with a stopper actuator for operatively engaging an actuating portion of said stopper, said stopper actuator being arranged opposite to said stopper actuating portion to define a gap between said stopper actuator and said stopper actuating portion; and, a bias spring for constantly forcing the holding portion of said stopper toward said gear, said gear being formed with a plurality of teeth and a second cutout along a second peripheral portion thereof which is opposite to the holding portion of said stopper when said gear is at a wick lowering position corresponding to a fire-extinguishing position of said wick, said second cutout having a depth larger than that of each of the teeth of said gear.

13. An automatic fire-extinguishing device for an oil burner including a burner body, comprising:

a wick operating shaft mounted on said burner body and rotated to vertically move a wick;

a gear loosely fitted on said wick operating shaft;

a return spring loosely fitted on said wick operating shaft and fixedly interposed between said gear and said burner body of said oil burner;

a pin member mounted on said wick operating shaft so as to radially extend therefrom;

a rod mounted on said gear so as to extend in an axial direction of said gear, said rod being engaged with said pin member to rotate said gear with said wick operating shaft to wind said return spring during a wick raising operation;

a stopper mounted on said burner body and including a holding portion for releasably engaging said gear to stop rotation of said gear to keep said return spring at a wound-up state, said gear being formed with a first cutout along a peripheral portion thereof which is opposite to the holding portion of said stopper when said gear is at a wick raising position corresponding to a combustion position of said wick;

a stop gear operatedly connected to said first gear and arranged at said first cutout so as to be engaged with the holding portion of said stopper as a substitute for said gear at its said wick raising position, said stop gear being formed with a tooth through which said stop gear is engaged with the holding portion of said stopper at the wick raising position to stop rotation of said gear, and said stop gear being made of a material having a friction coefficient smaller than that of said gear;

a vibration sensing weight tiltably supported on said burner body, said vibration sensing weight being provided with a stopper actuator for operatively engaging an actuating portion of said stopper, said stopper actuator being arranged opposite to said stopper actuating portion to define a gap between said stopper actuator and said stopper actuating portion;

a bias spring for constantly forcing the holding portion of said stopper toward said gear, said gear being formed with a plurality of teeth and a second cutout along a second peripheral portion thereof which is opposite to the holding portion of said stopper when said gear is at a wick lowering position corresponding to a fire-extinguishing position of said wick, said second cutout having a depth larger than that of each of the teeth of said gear;

an actuation spring mounted on said stopper; and, a push-up lever mounted on one of said wick operating shaft and gear, said push-up lever being arranged to be engaged with said actuation spring at the wick lowering position to abut said stopper actuating portion against said stopper actuator to raise up said vibration sensing weight when tilted.

* * * * *

UNITED STATES PATENT AND TRADEMARK OFFICE

CERTIFICATE OF CORRECTION

PATENT NO. : 4,790,745

DATED : December 13, 1988

INVENTOR(S) : YUTAKA NAKANISHI, et al.

It is certified that error appears in the above-identified patent and that said Letters Patent is hereby corrected as shown below:

Column 10, line 25, after "gear" insert

--and said burner body of said oil burner;
an engagement means for engaging said wick operating shaft with said gear to rotate said gear--.

Column 10, line 66, after "stopper" insert

--, said stopper actuator being arranged opposite to said stopper--.

Signed and Sealed this

Twenty-third Day of May, 1989

*Attest:*

*Attesting Officer*

DONALD J. QUIGG

*Commissioner of Patents and Trademarks*